United States Patent [19]

Edwards et al.

[11] 4,261,078

[45] Apr. 14, 1981

[54] CARRYING HANDLE

[75] Inventors: Rolland R. Edwards, Loveland; Lawrence R. Mobley, Parker, both of Colo.

[73] Assignee: Samsonite Corporation, Denver, Colo.

[21] Appl. No.: 114,099

[22] Filed: Jan. 21, 1980

[51] Int. Cl.[3] ..... A45C 13/26

[52] U.S. Cl. ..... 16/126; 190/39; 190/58 R

[58] Field of Search ..... 16/126; 190/58 R, 57, 190/39

[56] References Cited

U.S. PATENT DOCUMENTS

| | | | |
|---|---|---|---|
| 2,254,506 | 9/1941 | Wheary, Sr. | 190/58 R |
| 2,913,080 | 11/1959 | Louik et al. | 190/57 |
| 3,500,973 | 3/1970 | Bush | 190/57 |
| 3,559,779 | 2/1971 | Lautin | 16/126 X |
| 3,656,594 | 4/1972 | Marks et al. | 190/57 |
| 3,692,155 | 9/1972 | Laurita | 190/57 |
| 3,813,729 | 6/1974 | Szabo et al. | 190/57 X |

*Primary Examiner*—Andrew V. Kundrat
*Attorney, Agent, or Firm*—George J. Netter

[57] ABSTRACT

The handle includes an elongated grip constructed of a compliant material such as a molded foam rubber or plastic and has a pair of longitudinally extending parallel grooves on an upper surface, one adjacent each of the grip sides. The grip is molded about an elongated rigid member which serves to reinforce the grip throughout its entire length. A half-shell metal frame generally U-shaped in cross-section, has side edges received in the grooves of the grip and otherwise fits about the grip covering the top and part of the lateral sides. Mounting stanchions are provided one for each end of the handle assembly and are affixed to the top surface of a luggage case, beauty case, or the like. Each stanchion includes a stub shaft which is pivotally received through an opening in an end portion of the half-shell frame and reinforcing member.

5 Claims, 4 Drawing Figures

CARRYING HANDLE

The present invention relates generally to a carrying handle assembly, and, more particularly, to an improved carrying handle assembly for use on luggage, so-called beauty cases, attache cases or the like.

SUMMARY OF THE INVENTION

The handle assembly of this invention includes an elongated grip or gripping member constructed of a compliant material such as soft vinyl or foam rubber with a pair of longitudinally extending parallel grooves on an upper surface, one adjacent each of the grip sides. The grip is molded about an elongated rigid member which serves to stiffen or reinforce the grip throughout its length. A half-shell metal frame generally U-shaped in cross-section, has side edges received in the gooves of the grip and otherwise is fittingly received about the grip covering what in the final assembled form, is the top and part of the lateral sides thereof.

Mounting stanchions are provided one for each end of the handle assembly and are affixed to the top surface of a luggage case, beauty case, or the like. Each stanchion includes a stub shaft which is pivotally received through an opening in an end portion of the half-shell frame and reinforcing member.

DESCRIPTION OF A PREFERRED EMBODIMENT

Figure 1:
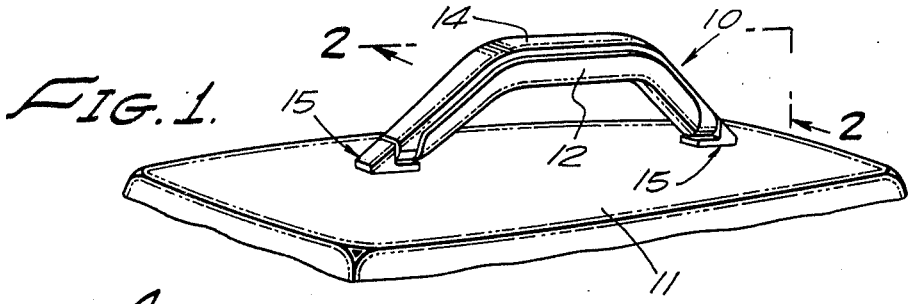
FIG. 1 is a perspective view of the top surface of one form of luggage case showing the handle assembly of this invention mounted thereon.

With reference now to the drawings and particularly FIG. 1, a luggage case top to which the handle assembly 10 of the invention is to be affixed is identified generally as at 11, and which can be any of the usual forms of luggage, including beauty cases, attached cases, or any other form of luggage. The handle assembly 10 to be described is secured to the luggage top 11 and in appearance is generally trapezoidal with the major handle gripping portion being straightline and parallel to the luggage case cover, and with two end portions extending angularly downwardly from the gripping portion for rotative securement to mounting stanchions affixed to the cover.

The handle assembly 10 includes in its various major components, a generally trapezoidal gripping member of grip 12, a reinforcing member 13 located within the grip, a half-shell metal frame 14 received over the top and partway down the sides of the grip, and a pair of mounting pedestals or stanchions 15 secured to the top of the cover and each including stub shafts rotatively received within the ends of the handle assembly for rotatively mounting the handle assembly to the luggage case cover.

The grip or gripping member 12 is elongate and has, in the elevational view, a generally trapezoidal appearance. The grip lower surface is rounded-off to a substantially circular periphery as can be seen best in FIG. 4. A pair of grooves 16 and 17 extend longitudinally throughout substantially the entire length of the grip on its upper surface, one closely adjacent each of the lateral sides. The portion of the grip lying between the grooves extends upwardly above the grooves with a somewhat rectangular cross-sectional appearance. The ends of the grip are faced off as at 19 parallel to each other and presenting a pair of planes at substantially 90 degrees to the central straightline portion of the grip. The grip is constructed of a flexible pliant material, such as vinyl or foam rubber, adding to the comfort of the user by being exceptionally soft and pliable to the touch.

Figure 4:
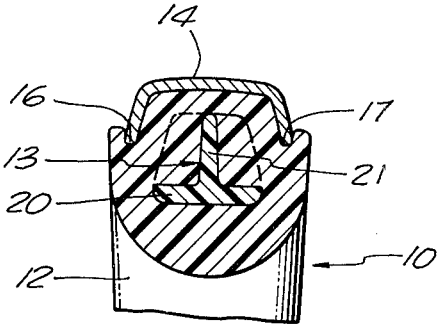
FIG. 4 is a further end elevational, sectional view taken along the line 4—4 of FIG. 2.

The reinforcing member 13 is molded or encapsulated within the grip 12 and extends throughout the full length of the grip providing a rigid support or reinforcement for the grip. Constructionally, the reinforcing member includes a flat plate-like base 20 which, as can be seen in FIG. 4, has a width approximately one-half that of the grip and extends along or slightly below the grip longitudinal axis. A continuous upstanding wall 21 extends along the centerline of and is integral with the base 20. At spaced intervals throughout the length there are a plurality of transverse walls 22, also integral with the base and the center wall and of a generally trapezoidal shape. The terminal end portions 23 of the reinforcing member extend outwardly of the respective faced-off grip ends 19 and include walls defining an openings 24. The end portions also have a pair of recessed shoulders 25 for a purpose to be described.

In manufacture of the parts described to this point, first the reinforcing member is individually molded from a suitable rigid hard plastic (e.g., thermoplastic polyester). Next, the grip 12 constructed of a soft vinyl or pliant rubber is molded about the reinforcing member completely enclosing it except for the terminal end portions 23. Molding the grip about the upstanding wall 21 and transverse walls 22 of the reinforcing member, anchors it securely within the grip insuring that the grip and reinforcing member will remain engaged throughout use.

Figure 2:
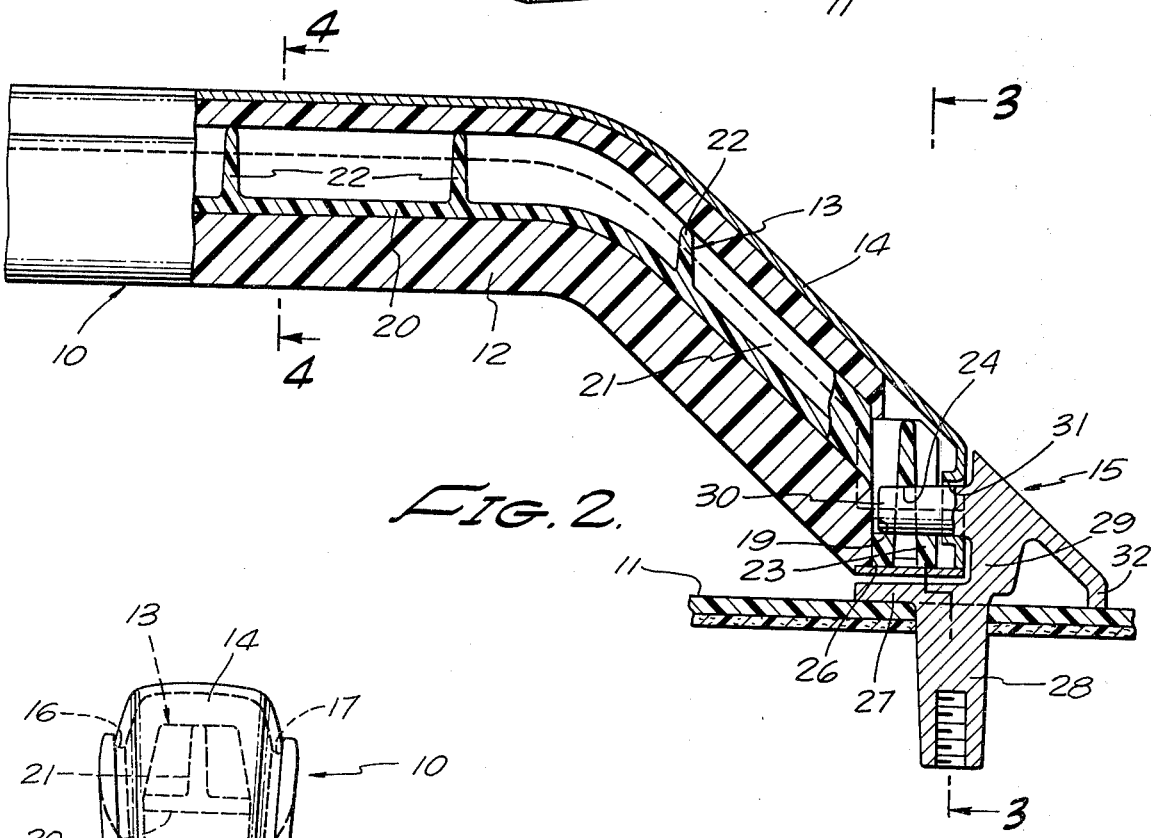
FIG. 2 is a sectional, elevational view of the handle assembly taken along the line 2—2 of FIG. 1.
Figure 3:
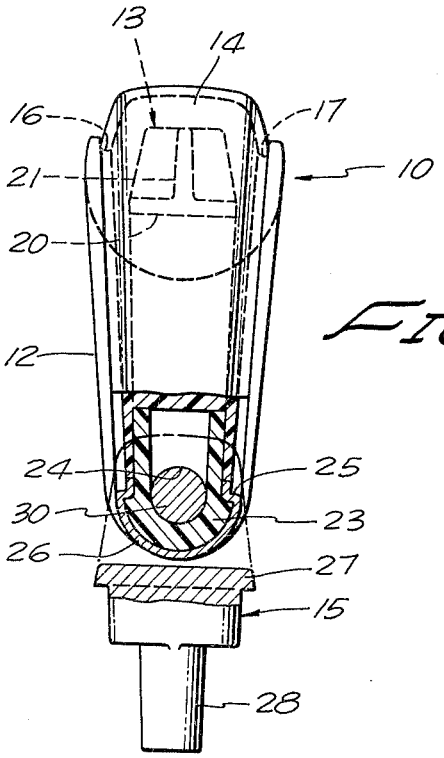
FIG. 3 is an end elevational, sectional view taken through a handle mounting stanchion along the line 3—3 of FIG. 2.

The metal frame 14 is received onto the grip extending along the grip straightline central portion, down the grip end portions and about each of the reinforcing member terminal end portions 23, as can be seen best in FIGS. 1 and 2. More particularly, the half-shell frame is contructed of stamped metal and has a cross-section that is similar to an inverted U, the edges of which fit into the grooves 16 and 17 of the grip and forms a metal cover over the top surface and part way down onto the lateral sides of the grip throughout its length. The end portions of the frame wrap about the reinforcing member terminal end portions with a U-shaped metal clip 26 being resiliently retained thereon by clamping engagement with the recessed shoulders 25 (FIG. 3).

The pair of mounting pedestals 15 which are used to rotatively anchor the handle assembly to the luggage case top are identical and only one of which will be described. A flat platelike base 27 has a cylindrical guidepost 28 that extends through a suitably shaped opening in the luggage top 11 and which is secured to the top in a known manner, such as by threaded means, for example. An upstanding portion 29 from the base 27 includes a stud or stub shaft 30 for receipt through the opening 31 in the metal frame and the opening 24 in the reinforcing member. An angularly arranged arm 32 extends from 29 and contacts the surface of the top 11 and serves to brace the stub shaft 30 when lifting forces are applied to it.

The invention claimed is:

1. A carrying handle, comprising:

a rigid member, including an elongated plate, an upstanding wall extending longitudinally of one major surface of the plate and integral with said plate, and a plurality of spaced transverse walls on the same major surface of the elongated plate as said wall and integral therewith, said member being elongate with a central straightline portion and two end portions extending angularly from the central portion in the same direction with all of said portions lying in the same plane, the terminal ends of said member having walls defining openings generally parallel to the straightline portion;

an elongate resilient grip formed about said rigid member and having a corresponding straightline central portion with two end portions angularly extending from said central portion leaving the rigid member terminal ends free, said grip including a pair of longitudinal grooves on an outer surface;

an elongated metal cover of generally U-shaped cross-section received onto the grip with edges lying in the grooves of the grip and partially enclosing the rigid member end portions;

first and second metal clips received onto the rigid member end portions securing the cover to said member end portions; and first and second mounting means each having a stub shaft rotatably received within the respective rigid member terminal end openings.

2. A carrying handle as in claim 1, in which the grip is constructed of injection molded vinyl.

3. A carrying handle as in claim 1, in which the grip is constructed of foam rubber.

4. A carrying handle as in claim 1, in which the grip is molded about the rigid member in intimate contact with the outer surface of said rigid member.

5. A carrying handle as in claim 1, in which the rigid member terminal ends include recessed shoulders within which parts of the metal clips are received for releasably securing the clips to said rigid member.

* * * * *